US009968236B2

(12) United States Patent
Thiyagarajan et al.

(10) Patent No.: US 9,968,236 B2
(45) Date of Patent: May 15, 2018

(54) DISHWASHER APPLIANCE AND A METHOD FOR OPERATING THE SAME

(71) Applicant: General Electric Company, Schenectady, NY (US)

(72) Inventors: Ramasamy Thiyagarajan, Louisville, KY (US); Matthew David Mersch, Louisville, KY (US); Ronald Scott Tarr, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 782 days.

(21) Appl. No.: 14/487,365

(22) Filed: Sep. 16, 2014

(65) Prior Publication Data

US 2016/0073851 A1 Mar. 17, 2016

(51) Int. Cl.
*A47L 15/42* (2006.01)

(52) U.S. Cl.
CPC ..... *A47L 15/4208* (2013.01); *A47L 15/4206* (2013.01); *A47L 2501/03* (2013.01)

(58) Field of Classification Search
CPC ..... A47L 15/4202; A47L 15/4208; A47L 15/4214; A47L 15/4225; A47L 2501/03
See application file for complete search history.

(56) References Cited

U.S. PATENT DOCUMENTS

| | | | | |
|---|---|---|---|---|
| 5,609,172 | A * | 3/1997 | Chang | A47L 15/4208 134/104.1 |
| 2006/0237049 | A1* | 10/2006 | Weaver | A47L 15/4204 134/56 D |
| 2006/0237050 | A1* | 10/2006 | Weaver | A47L 15/4208 134/56 D |
| 2008/0041419 | A1* | 2/2008 | Gaus | A47L 15/24 134/10 |
| 2011/0197934 | A1* | 8/2011 | Fueglein | A47L 15/4208 134/111 |
| 2012/0024773 | A1 | 2/2012 | Morrison et al. | |

FOREIGN PATENT DOCUMENTS

| | | | | |
|---|---|---|---|---|
| EP | 0990413 | A1 * | 4/2000 | A47L 15/4206 |
| EP | 2213217 | A1 * | 8/2010 | A47L 15/4204 |

* cited by examiner

*Primary Examiner* — Marc Lorenzi
(74) *Attorney, Agent, or Firm* — Dority & Manning, P.A.

(57) ABSTRACT

The present subject matter provides a method for operating a dishwasher appliance. The method includes finely filtering wash fluid with a fine filtration medium via cross-flow filtration and coarsely filtering wash fluid with a coarse filtration medium via dead-end filtration. The finely filtered wash fluid is directed to a spray assembly of the dishwasher appliance. A related dishwasher appliance is also provided.

13 Claims, 5 Drawing Sheets

DISHWASHER APPLIANCE AND A METHOD FOR OPERATING THE SAME

FIELD OF THE INVENTION

The present subject matter relates generally to dishwasher appliances and methods for operating dishwasher appliances.

BACKGROUND OF THE INVENTION

During wash and rinse cycles, dishwasher appliances generally circulate a fluid through a wash chamber over articles, such as pots, pans, silverware, etc. The fluid can be, e.g., various combinations of water and detergent during the wash cycle or water (which may include additives) during the rinse cycle. Typically, the fluid is circulated during a given cycle using a pump. Fluid is collected at or near the bottom of the wash chamber and pumped back into the wash chamber through, e.g., nozzles in spray arms and other openings that direct the fluid against the articles to be cleaned or rinsed.

Depending upon the level of soil on the articles, fluids used during wash and rinse cycles will become contaminated with soils in the form of debris or particles that are carried with the fluid. In order to protect the pump and recirculate the fluid through the wash chamber, it is beneficial to filter the fluid so that relatively clean fluid is applied to the articles in the wash chamber and materials are removed or reduced from the fluid supplied to the pump.

For mechanical filtration, the selectivity of the filter to remove soil particles of different sizes is typically determined by providing fluid paths (such as pores or apertures) through filter media that are smaller than the particles for which filtration is desired. Particles having a dimension larger than the width of the fluid paths will be trapped or prevented from passing through the filter media while particles smaller than the width of the fluid path will generally pass through. Certain particle sizes and/or types may be not harmful to the pump or spray assemblies and, therefore, can be allowed to pass into the pump inlet. However, while some smaller particles may not be harmful to the pump, leaving such particles in the wash or rinse fluid may not be acceptable as these particles may become deposited on the articles being washed/rinsed and thereby affect the user's perception of the cleanliness and/or appearance.

While larger particles can generally be readily removed from the fluid circulated through the wash chamber, challenges are presented in removing smaller particles—particularly as the particle size targeted for removal decreases. For example, if a dishwashing appliance is provided with a fine particle filter—such as one for removing particles 200 microns or larger—the filter can be prone to clogging particularly during the early stages of the cleaning process. During a pre-wash cycle or early stage of a wash cycle, a greater amount of larger food particles may be present on the articles placed in the wash chamber. A fine particle filter—such as one for removing particles 200 microns are larger—may become substantially clogged.

To unclog the filter, a conventional approach has been to drain the dirty fluid from the wash chamber to remove the particles clogging the filter. New—i.e. clean fluid—is then reintroduced for cycling again. Depending on the level of soil still present on the articles, yet another cycle of draining and refilling may have to be repeated. Unfortunately, this run, drain, and refill approach for unclogging a filter is inefficient as it requires the use of additional fluid (i.e. water). Of course, a filter media can be selected that only captures larger particles so that it clogs less, such as e.g., 0.030" or larger, but this comes at the expense of losing the ability to remove smaller particles from the fluid and an associated effect on the resulting cleanliness of the articles.

Accordingly, a dishwasher appliance having filtering system for the removal of particles from the wash fluid would be useful. More particularly, a method for operating a dishwasher appliance with steps for reducing or preventing clogging of a filtering system would be useful.

BRIEF DESCRIPTION OF THE INVENTION

The present subject matter provides a method for operating a dishwasher appliance. The method includes finely filtering wash fluid with a fine filtration medium via cross-flow filtration and coarsely filtering wash fluid with a coarse filtration medium via dead-end filtration. The finely filtered wash fluid is directed to a spray assembly of the dishwasher appliance. A related dishwasher appliance is also provided. Additional aspects and advantages of the invention will be set forth in part in the following description, or may be apparent from the description, or may be learned through practice of the invention.

In a first exemplary embodiment, a method for operating a dishwasher appliance is provided. The dishwasher appliance has a tub that defines a wash chamber. The dishwasher appliance also has a filter assembly with a fine filtration filter medium and a coarse filtration medium. The method includes actuating a diverter valve of the dishwasher appliance to a first configuration and operating a first pump and a second pump of the dishwasher appliance after the step of actuating the diverter valve to the first configuration. The first pump draws wash fluid from an unfiltered volume of the filter assembly through the fine filtration medium and directs the wash fluid to the spray assembly during the step of operating. The second pump urges the wash fluid from the unfiltered volume of the filter assembly through the coarse filtration medium and directs the wash fluid to the wash chamber of the tub during the step of operating. The method also includes actuating the diverter valve of the dishwasher appliance to a second configuration after the step of operating and working the second pump of the dishwasher appliance after the step of actuating the diverter valve of the dishwasher appliance to the second configuration. The first pump is deactivated during the step of working. The second pump urges the wash fluid from the unfiltered volume of the filter assembly to a drain of the dishwasher appliance during the step of working.

In a second exemplary embodiment, a dishwasher appliance is provided. The dishwasher appliance includes a tub that defines a wash chamber. A spray assembly is positioned within the wash chamber. A sump is positioned at a bottom portion of the tub. A filter assembly is disposed within the sump. The filter assembly assists with defining a finely filtered volume, a soil collection volume and an unfiltered volume within the sump. The filter assembly has a fine filtration filter medium and a coarse filtration medium. The fine filtration medium is disposed between the unfiltered volume and the finely filtered volume within the sump. The coarse filtration medium is disposed between the soil collection chamber and the wash chamber of the tub. A spray conduit extends between the finely filtered volume of the filter assembly and the spray assembly. A first pump is coupled to the spray conduit and is configured for selectively urging wash fluid from the finely filtered volume of the sump to the spray assembly through the spray conduit. A circulation conduit extends between the unfiltered volume of the filter assembly and the soil collection chamber. A second pump is coupled to the circulation conduit and is configured for selectively drawing wash fluid from the unfiltered volume of the filter assembly. A diverter valve is coupled to the circulation conduit. The diverter valve is configured for selectively directing wash fluid from the unfiltered volume of the filter assembly to either the soil collection chamber or a drain.

In a third exemplary embodiment, a method for operating a dishwasher appliance is provided. The dishwasher appliance has a tub that defines a wash chamber. The dishwasher appliance also has a filter assembly with a fine filtration filter medium and a coarse filtration medium. The method includes operating a first pump and a second pump of the dishwasher appliance, finely filtering wash fluid from an unfiltered volume of the filter assembly with the fine filtration medium via cross-flow filtration at the step of operating, directing the finely filtered wash fluid to the spray assembly after the step of finely filtering, coarsely filtering wash fluid from the unfiltered volume of the filter assembly with the coarse filtration medium via dead-end filtration at the step of operating, and directing the coarsely filtered wash fluid to the wash chamber of the tub after the step of coarsely filtering.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
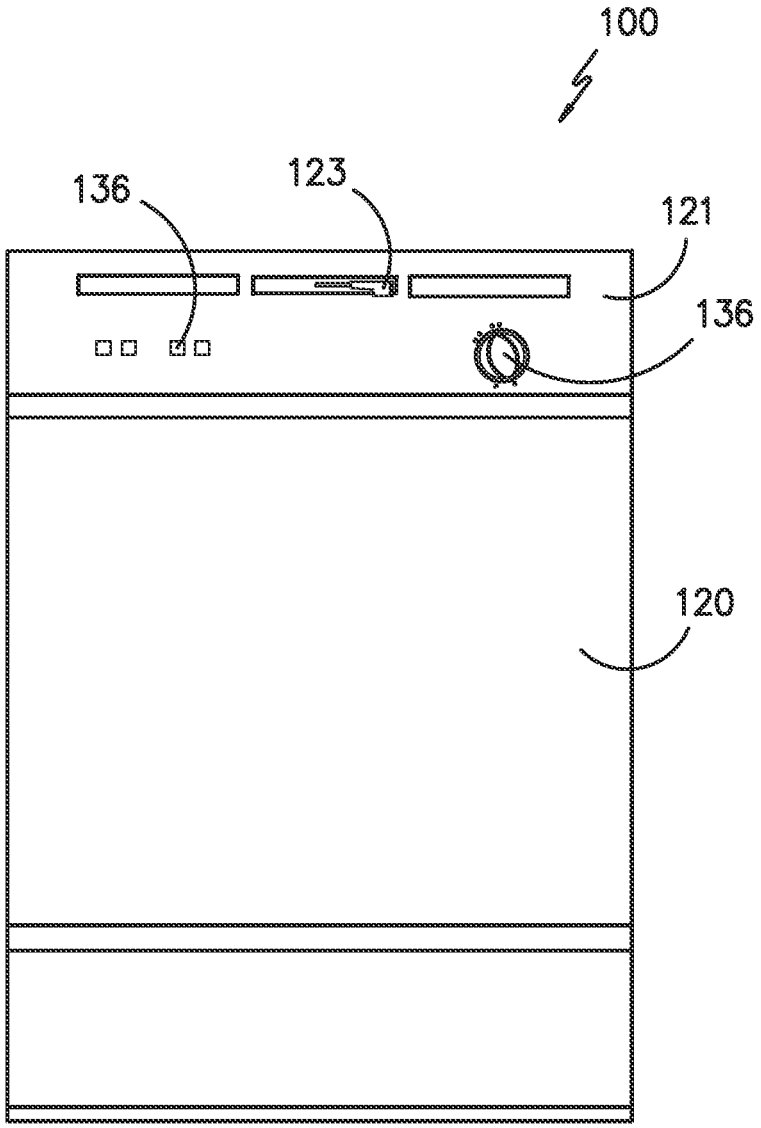
FIG. 1 provides a front elevation view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
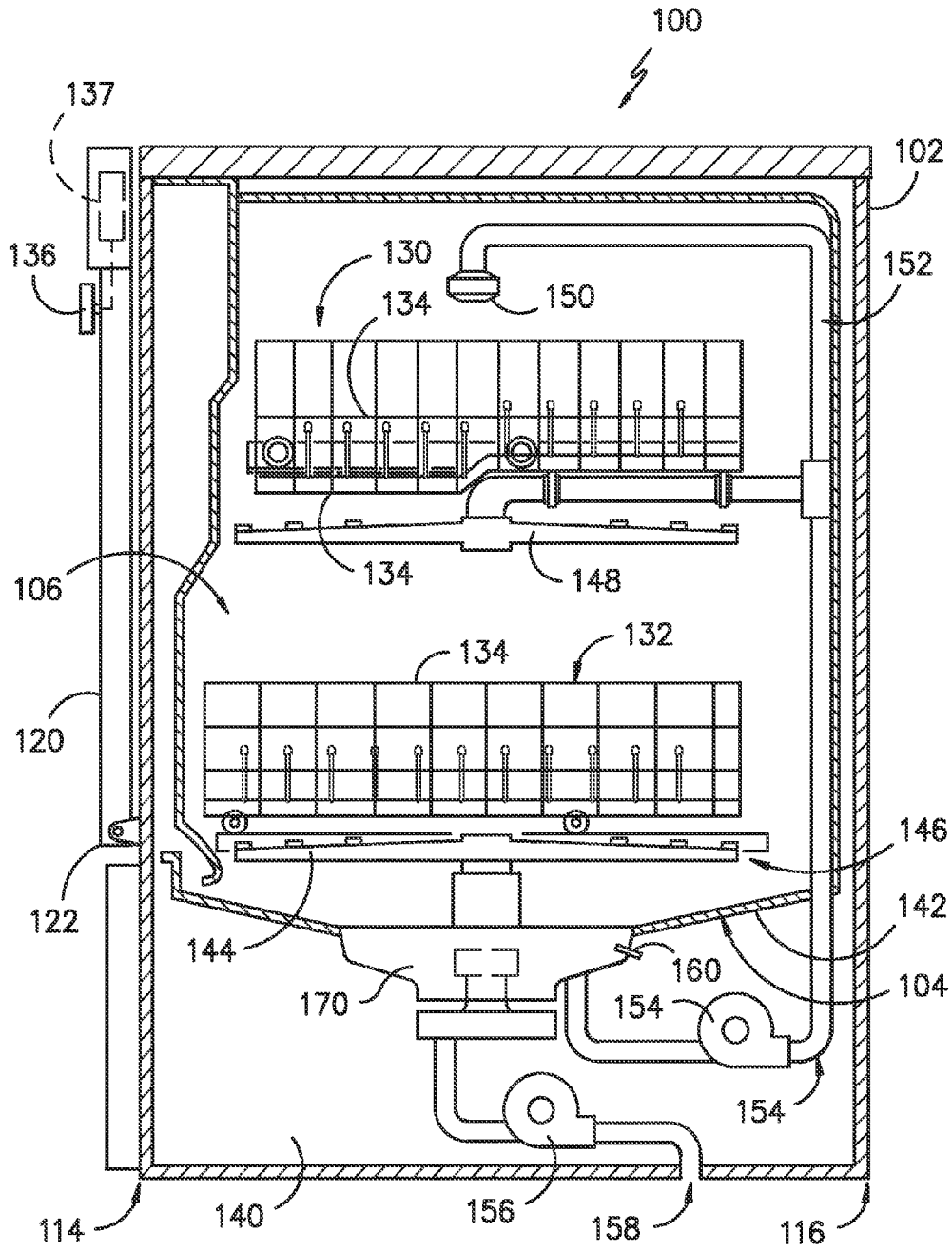
FIG. 2 provides a side, section view of the exemplary dishwasher appliance of FIG. 1.

FIGS. 1 and 2 depict a dishwasher appliance 100 according to an exemplary embodiment of the present subject matter. As shown in FIG. 1, dishwasher appliance 100 includes a cabinet 102. Cabinet 102 has a tub 104 therein that defines a wash chamber or compartment 106. The tub 104 also defines a front opening (not shown). Dishwasher appliance 100 includes a door 120 hinged at a bottom 122 of door 120 for movement between a normally closed, vertical position (shown in FIGS. 1 and 2), wherein wash compartment 106 is sealed shut for washing operation, and a horizontal, open position for loading and unloading of articles from dishwasher appliance 100. Latch 123 is used to lock and unlock door 120 for access to wash compartment 106. Tub 104 also includes a sump assembly 170 positioned adjacent a bottom portion 112 of tub 104 and configured for receipt of a liquid wash fluid (e.g., water, detergent, wash fluid, and/or any other suitable fluid) during operation of dishwasher appliance 100.

A spout 160 is positioned adjacent sump assembly 170 of dishwasher appliance 100. Spout 160 is configured for directing liquid into sump assembly 170. Spout 160 may receive liquid from a water supply, such as a municipal water supply or a well. In alternative embodiments, spout 160 may be positioned at any suitable location within dishwasher appliance 100, e.g, such that spout 160 directs liquid into tub 104. Spout 160 may include a valve (not shown) such that liquid may be selectively directed into tub 104. Thus, for example, during the cycles described below, spout 160 may selectively direct water and/or wash fluid into sump assembly 170 as required by the current cycle of dishwasher appliance 100.

Rack assemblies 130 and 132 are slidably mounted within wash compartment 106. Each of the rack assemblies 130 and 132 is fabricated into lattice structures including a plurality of elongated members 134. Each rack of the rack assemblies 130 and 132 is adapted for movement between an extended loading position (not shown) in which the rack is substantially positioned outside the wash compartment 106, and a retracted position (shown in FIGS. 1 and 2) in which the rack is located inside the wash compartment 106. A silverware basket (not shown) may be removably attached to rack assembly 132 for placement of silverware, utensils, and the like, that are otherwise too small to be accommodated by the racks 130 and 132.

Dishwasher appliance 100 further includes a lower spray assembly 144 that is rotatably mounted within a lower region 146 of the wash compartment 106 and above sump assembly 170 so as to rotate in relatively close proximity to rack assembly 132. A mid-level spray assembly 148 is located in an upper region of the wash compartment 106 and may be located in close proximity to upper rack 130. Additionally, an upper spray assembly 150 may be located above the upper rack 130.

The lower and mid-level spray assemblies 144 and 148 and the upper spray assembly 150 are fed by a fluid circulation assembly 152 for circulating water and dishwasher fluid in the tub 104. Fluid circulation assembly 152 may include a wash or recirculation pump 154 and a cross-flow/drain pump 156 located in a machinery compartment 140 located below sump assembly 170 of the tub 104, as generally recognized in the art. Cross-flow/drain pump 156 is configured for urging wash fluid within sump assembly 170 out of tub 104 and dishwasher appliance 100 to a drain 158. Recirculation pump 154 is configured for supplying a flow of wash fluid from sump assembly 170 to spray assemblies 144, 148 and 150.

Each spray assembly 144 and 148 includes an arrangement of discharge ports or orifices for directing wash fluid onto dishes or other articles located in rack assemblies 130 and 132. The arrangement of the discharge ports in spray assemblies 144 and 148 provides a rotational force by virtue of wash fluid flowing through the discharge ports. The resultant rotation of the lower spray assembly 144 provides coverage of dishes and other dishwasher contents with a spray of wash fluid.

Dishwasher appliance 100 is further equipped with a controller 137 to regulate operation of the dishwasher appliance 100. Controller 137 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 137 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 137 may be positioned in a variety of locations throughout dishwasher appliance 100. In the illustrated embodiment, controller 137 may be located within a control panel area 121 of door 120 as shown. In such an embodiment, input/output ("I/O") signals may be routed between the control system and various operational components of dishwasher appliance 100 along wiring harnesses that may be routed through the bottom 122 of door 120. Typically, controller 137 includes a user interface panel 136 through which a user may select various operational features and modes and monitor progress of the dishwasher appliance 100. In one embodiment, user interface 136 may represent a general purpose I/O ("GPIO") device or functional block. In one embodiment, user interface 136 may include input components, such as one or more of a variety of electrical, mechanical or electro-mechanical input devices including rotary dials, push buttons, and touch pads. User interface 136 may include a display component, such as a digital or analog display device designed to provide operational feedback to a user. User interface 136 may be in communication with controller 137 via one or more signal lines or shared communication busses.

It should be appreciated that the subject matter disclosed herein is not limited to any particular style, model or configuration of dishwasher appliance, and that the embodiment depicted in FIGS. 1 and 2 is for illustrative purposes only. For example, instead of the racks 130 and 132 depicted in FIG. 1, dishwasher appliance 100 may be of a known configuration that utilizes drawers that pull out from the cabinet and are accessible from the top for loading and unloading of articles.

Figure 3:
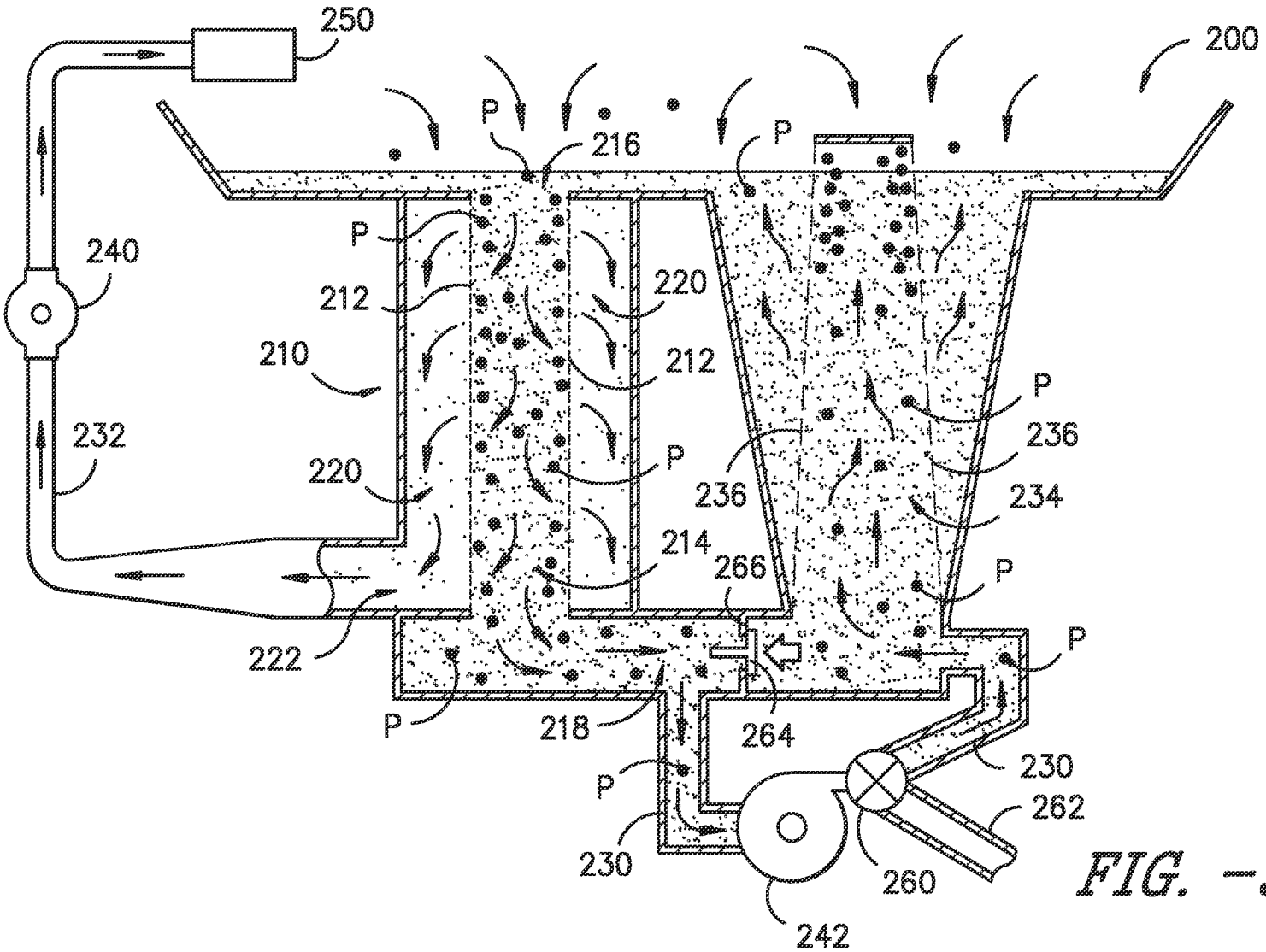
FIGS. 3 and 4 provide schematic views of a sump and a filter assembly according to an exemplary embodiment of the present subject matter.
Figure 4:
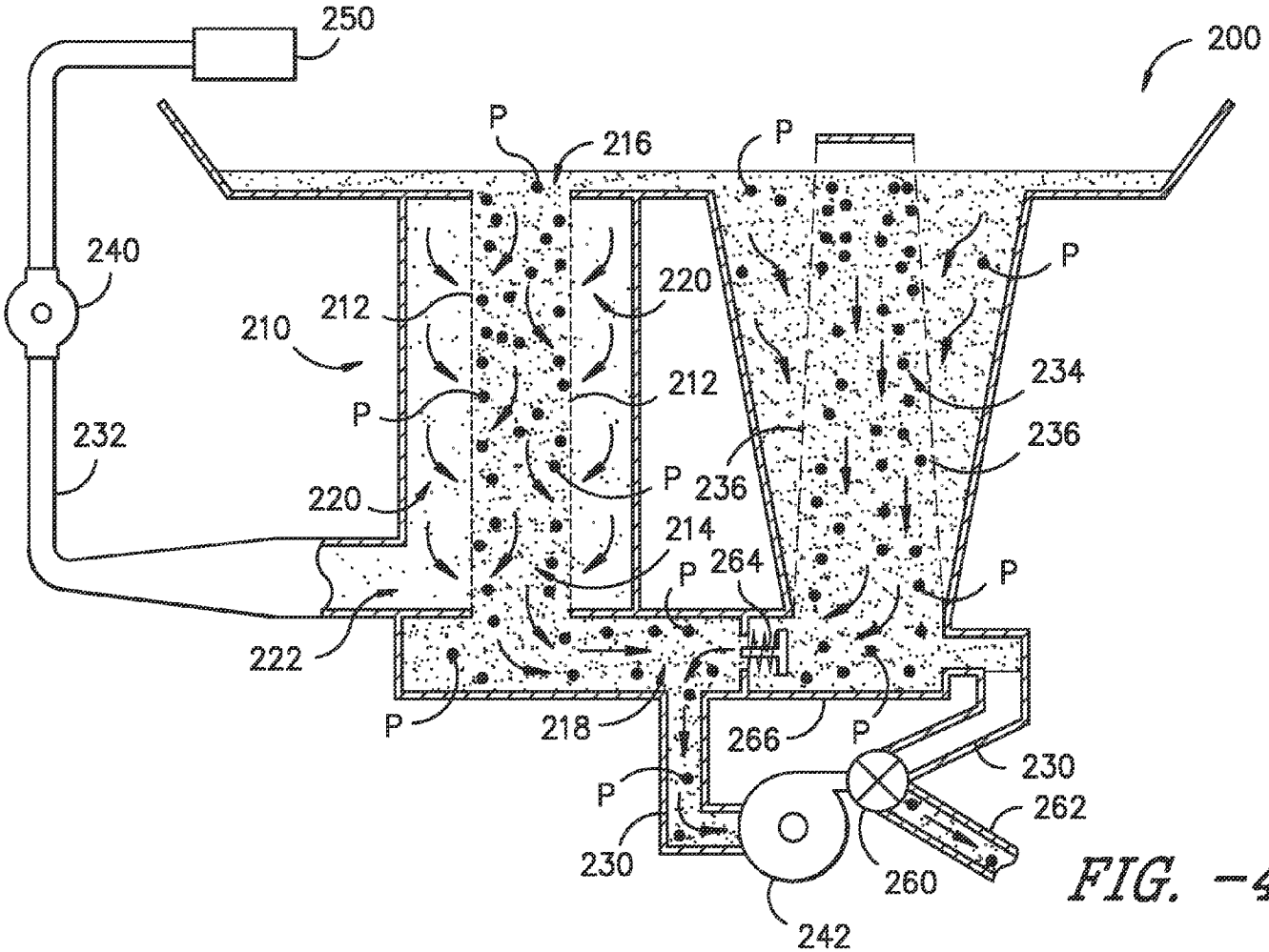

FIGS. 3 and 4 provide schematic views of a sump 200 and a filter assembly 210 according to an exemplary embodiment of the present subject matter. Sump 200 and filter assembly 210 may be used in any suitable appliance. For example, sump 200 and filter assembly 210 may be used in dishwasher appliance 100 (FIG. 2), e.g., as sump assembly 170. In dishwasher appliance 100, filter assembly 210 filters liquid passing therethrough and supplies filtered liquid to at least one of spray assemblies 144, 148 and 150. Filtering liquid supplied to spray assemblies 144, 148 and 150 can assist with limiting or preventing clogging of spray assemblies 144, 148 and 150.

As may be seen in FIGS. 3 and 4, filter assembly 210 includes fine filter media 212 and coarse filter media 236. Filter assembly 210 also includes or defines an unfiltered volume 214, a filtered volume 220 and a soil collection chamber 234. Fine filter media 212 are disposed between filtered volume 220 and unfiltered volume 214. As used herein, the term "unfiltered volume" describes a volume that is not filtered relative to fine filter media 212 and the term "filtered volume" describes a volume that is filtered relative to fine filter media 212. However, as will be understood by those skilled in the art, filter assembly 210 may include additional filters that filter liquid entering unfiltered volume 214. Thus, unfiltered volume 214 may be filtered relative to other filters but not fine filter media 212. During operation filter assembly 210, fine filter media 212 may be fixed or static within filter assembly 210.

Unfiltered volume 214 has at least one entrance 216 and at least one exit 218. Entrance 216 of unfiltered volume 214 is in fluid communication with sump 200. Thus, unfiltered volume 214 is configured for receipt of liquid from sump 200, and liquid in sump 200 flows into unfiltered volume 214 via entrance 216 of unfiltered volume 214. As discussed in greater detail below, liquid in unfiltered volume 214 passes or flows through fine filter media 212 into filtered volume 220. Fine filter media 212 removes debris or particles P from liquid passing through fine filter media 212 from unfiltered volume 214 to filtered volume 220. Thus, unfiltered liquid passes through fine filter media 212 to remove debris or particles P and exits fine filter media 212 into filtered volume 220 as finely filtered liquid. Filtered volume 220 also includes an exit 222. Finely filtered liquid within filtered volume 220 then exits filtered volume 220 via exit 222 of filtered volume 220. In such a manner, unfiltered liquid follows a path through filter assembly 210. In particular, unfiltered liquid passes through fine filter media 212, and finely filtered liquid exits filter assembly 210. Such filtering can assist with limiting or preventing clogs in associated spray assemblies of an appliance. In addition, filter assembly 210 generates a cross flow across fine filter media 212. Such cross flow can assist with limiting or preventing clogging or saturation of fine filter media 212 with debris or particles P.

Liquid in unfiltered volume 214 can also pass or flow out of unfiltered volume 214 via exit 218 of unfiltered volume 214. As may be seen in FIGS. 3 and 4, soil collection chamber 234 is positioned at exit 218 of unfiltered volume 214. Thus, soil collection chamber 234 may be positioned downstream of unfiltered volume 214. Soil collection chamber 234 may also be continuous or contiguous with unfiltered volume 214 of filter assembly 210 in order to receive unfiltered liquid from unfiltered volume 214. Coarse filter media 236 are positioned between soil collection chamber 234 and sump 200. Thus, liquid flowing through unfiltered volume 214 enters soil collection chamber 234 and passes through coarse filter media 236 to sump 200. Thus, rather than flowing through fine filter media 212 into filtered volume 220 as described above, liquid in unfiltered volume 214 also passes or flows out of unfiltered volume 214 via exit 218 of unfiltered volume 214. The bypassed liquid flows into soil collection chamber 234 without being filtered by or with fine filter media 212. Coarse filter media 236 removes debris or particles P from liquid passing through coarse filter media 236 from soil collection chamber 234 to sump 200. Thus, unfiltered liquid passes through coarse filter media 236 to remove debris or particles P and exits coarse filter media 236 into sump 200 as coarsely filtered liquid. In such a manner, unfiltered liquid follows a path through filter assembly 210. In particular, unfiltered liquid passes through coarse filter media 236, and coarsely filtered liquid exits filter assembly 210. Such filtering can assist with collecting large particles P within soil collecting chamber 234 in order to improve performance of filter assembly 210. In particular, filter assembly 210 may collect large particles P within soil collection chamber 234 via dead end filtration with coarse filter media 236. Such dead end filtration can assist with limiting or preventing clogging or saturation of fine filter media 212 with debris or particles P.

Filter assembly 210 includes a first pump 240, a second pump 242, a circulation or exit conduit 230 and a spray conduit 232. Exit conduit 230 extends from exit 218 of unfiltered volume 214 to second pump 242. Second pump 242 is operable to draw liquid from unfiltered volume 214 to or towards second pump 242 via exit conduit 230. Second pump 242 may be any suitable pump. For example, when used in dishwasher appliance 100 (FIG. 1), Second pump 242 may be cross-flow/drain pump 156. Exit conduit 230 may also extend from exit 218 of unfiltered volume 214 to soil collection chamber 234. Thus, exit conduit 230 may be arranged or configured for directing liquid from unfiltered volume 214 to soil collection chamber 234, e.g., during operation of second pump 242.

In addition, a diverter valve 260 is coupled to exit conduit 230. Diverter valve 260 is operable to regulate a flow of liquid through exit conduit 230. In particular, diverter valve 260 is selectively adjustable between a filter or first configuration and a drain or second configuration. In the first configuration, diverter valve 260 may permit liquid in exit conduit 230 to flow through diverter valve 260 to soil collection chamber 234, e.g., as described above. Conversely, diverter valve 260 may direct liquid in exit conduit 230 to a drain 262 in the second configuration. Fluid in drain 262 may be directed out of dishwasher appliance 100, e.g., to an associated sewer or septic system. Thus, diverter valve 260 may direct liquid flowing through exit conduit 230 to soil collection chamber 234 or drain 262 depending upon the configuration or position of diverter valve 260. Diverter valve 260 may be any suitable valve. For example, diverter valve 260 may be a solenoid valve or a three-way ball valve. Controller 137 may be in operative communication with diverter valve 260 such that controller 137 may actuate diverter valve 260 between the first and second configurations.

Filter assembly 210 also includes a one-way valve 264 and a connecting conduit 266. As may be seen in FIGS. 3 and 4, connecting conduit 266 extends between unfiltered volume 214 and soil collection chamber 234. One-way valve 264 is positioned at or within connecting conduit 266. One-way valve 264 may be any suitable type of valve. For example, one-way valve 264 may be a spring loaded check valve, a solenoid valve configured to operate as a one-way valve, etc. One-way valve 264 is configured for hindering or preventing wash fluid from unfiltered volume 214 from flowing to soil collection chamber 234 via connecting conduit 266. For example, one-way valve 264 may be configured to actuate to a closed configuration by wash fluid from second pump 242, as shown in FIG. 4, in order to hinder or prevent wash fluid from unfiltered volume 214 from flowing to soil collection chamber 234 via connecting conduit 266. Thus, one-way valve 264 may be a normally open valve, in certain exemplary embodiments.

Spray conduit 232 extends from exit 222 of filtered volume 220 to first pump 240. First pump 240 is operable to draw liquid from filtered volume 220 to or towards first pump 240 via spray conduit 232. First pump 240 may be any suitable pump. For example, when used in dishwasher appliance 100 (FIG. 1), first pump 240 may be recirculation pump 154. Spray conduit 232 may also extend from exit 222 of filtered volume 220 to a spray assembly 250. Thus, spray conduit 232 may be arranged or configured for directing liquid from filtered volume 220 to the spray assembly 250, e.g., during operation of first pump 240. When used in dishwasher appliance 100, spray conduit 232 may be arranged or configured for directing liquid from filtered volume 220 to at least one of spray assemblies 144, 148 and 150, e.g., during operation of recirculation pump 154.

Fine filter media 212 may be configured for fine filtration—e.g. filtering of relatively small particles. Accordingly, in one exemplary aspect of the present subject matter, fine filter media 212 may be configured (e.g., define holes or apertures) for removing particles in the size range of about (e.g., within ten percent of) fifty microns to about four hundred microns. For example, fine filter media 212 may be a screen or mesh having holes in the size range of about fifty microns to about four hundred microns. In another exemplary aspect of the present subject matter, fine filter media 212 may be configured (e.g., define holes or apertures) for removing particles in the size range of about three hundred microns to about six hundred microns. For example, fine filter media 212 may be a screen or mesh having holes in the size range of about three hundred microns to about six hundred microns. In another exemplary aspect of the present subject matter, fine filter media 212 may be configured (e.g., define holes or apertures) for removing particles in the size range of about one micron to about one thousand microns. For example, fine filter media 212 may be a screen or mesh having holes in the size range of about one micron to about one thousand microns. In another exemplary aspect of the present subject matter, fine filter media 212 may be configured (e.g., define holes or apertures) for removing particles in the size range of about fifty microns to about four hundred microns. For example, fine filter media 212 may be a screen or mesh having holes in the size range of about fifty microns to about four hundred microns. These size ranges are provided by way of example only. Other ranges may be used in certain exemplary embodiments of the present subject matter as well.

Coarse filter media 236 may be configured for coarse filtration—e.g. filtering of relatively large particles. Accordingly, in one exemplary aspect of the present subject matter, coarse filter media 236 may be configured (e.g., define holes or apertures) for removing particles in the size range of about one thousand microns to about ten thousand microns. For example, coarse filter media 236 may be a screen or mesh having holes in the size range of about one thousand microns to about ten thousand microns. In another exemplary aspect of the present subject matter, coarse filter media 236 may be configured (e.g., define holes or apertures) for removing particles in the size range of about two thousand microns to about eight thousand microns. For example, coarse filter media 236 may be a screen or mesh having holes in the size range of about two thousand microns to about eight thousand microns. In another exemplary aspect of the present subject matter, coarse filter media 236 may be configured (e.g., define holes or apertures) for removing particles in the size range of about four hundred microns to about ten thousand microns. For example, coarse filter media 236 may be a screen or mesh having holes in the size range of about four hundred microns to about ten thousand microns. In another exemplary aspect of the present subject matter, coarse filter media 236 may be configured (e.g., define holes or apertures) for removing particles in the size range of about five hundred microns to about two thousand microns. For example, coarse filter media 236 may be a screen or mesh having holes in the size range of about four hundred microns to about two thousand microns. These size ranges are provided by way of example only. Other ranges may be used in certain exemplary embodiments of the present subject matter as well.

Figure 5:
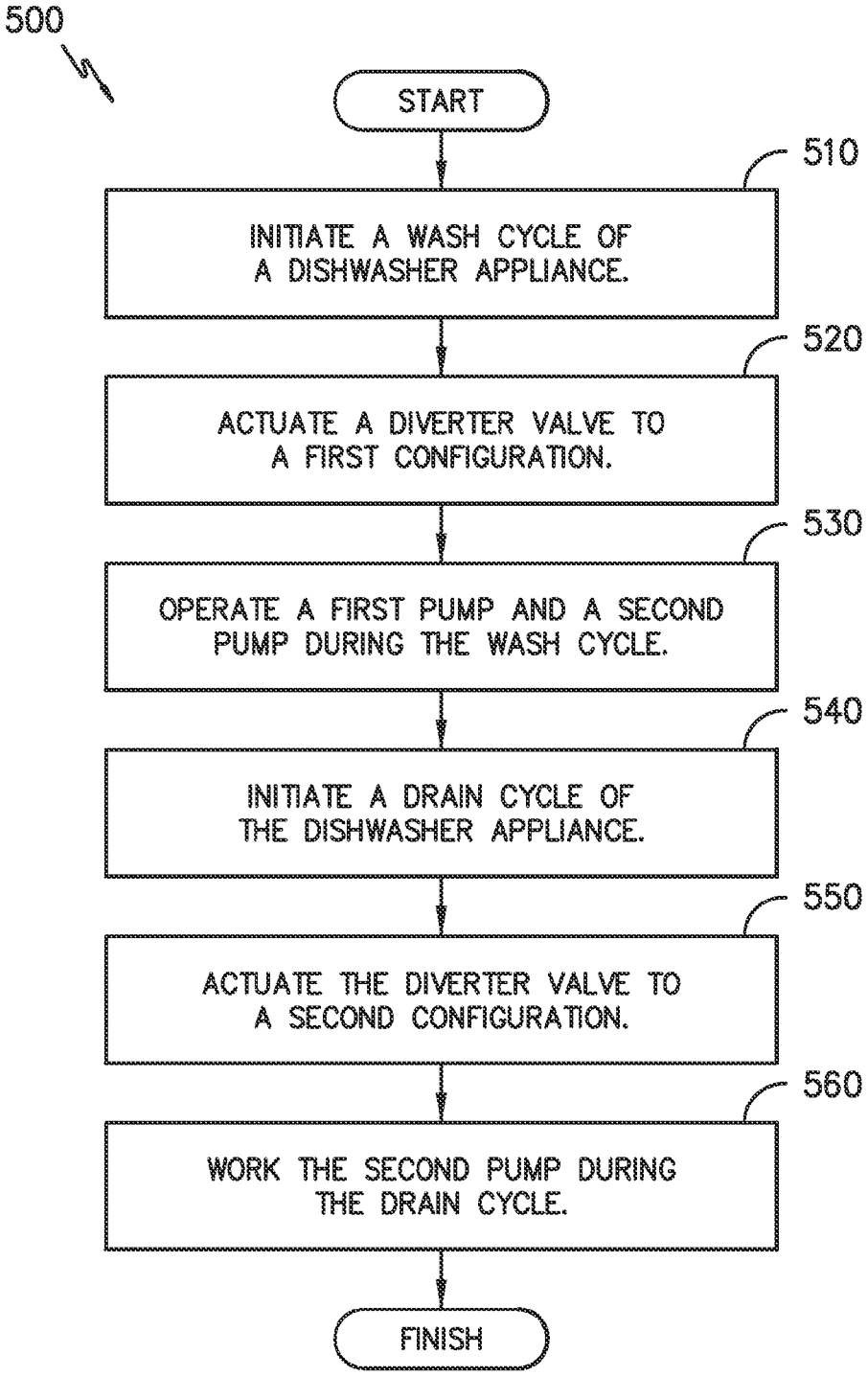
FIG. 5 illustrates a method for operating a dishwasher appliance according to an exemplary embodiment of the present subject matter.

FIG. 5 illustrates a method 500 for operating a dishwasher appliance according to an exemplary embodiment of the present subject matter. Method 500 may be used to operate any suitable dishwasher appliance. For example, method 500 may be used to operate dishwasher appliance 100 (FIG. 1). In particular, controller 137 may be configured or programmed to implement method 500. Utilizing method 500, wash fluid within dishwasher appliance 100 is filtered and clogging of a filter assembly, such as filter assembly 210 (FIG. 3), is also reduced or prevented, as discussed in greater detail below.

At step 510, a wash cycle of dishwasher appliance 100 is initiated. As an example, a user of dishwasher appliance 100 may load articles for washing into rack assemblies 130 and 132 within wash compartment 106. The user may then actuate a button or dial on user interface panel 136 to initiate the wash cycle of dishwasher appliance 100 at step 510. The sump 200 may be filled with liquid wash fluid during the wash cycle of dishwasher appliance 100 via spout 160.

At step 520, diverter valve 260 is adjusted or actuated to the first configuration. Thus, as shown in FIG. 3, wash fluid within filter assembly 210 may flow from unfiltered volume 214 through diverter valve 260 to soil collection chamber 234 via exit conduit 230 when diverter valve 260 is in the first configuration. Step 520 may be conducted at any suitable time. For example, diverter valve 260 may default to the first configuration. Thus, diverter valve 260 may actuate to the first configuration whenever an actuating mechanism stops holding the diverter valve 260 in the first configuration. As another example, diverter valve 260 may be actuated to the first configuration at a start of the wash cycle of dishwasher appliance 100 at step 510.

At step 530, first pump 240 and second pump 242 are operated or activated after step 520, e.g., such that diverter valve 260 is in the first configuration during step 530. In FIG. 3, sump 200 and filter assembly 210 are shown during step 530 such that first pump 240 and second pump 242 are operating. As may be seen in FIG. 3, first pump 240 draws wash fluid from unfiltered volume 214 through fine filtration media 212 into filtered volume 220 during step 530. In addition, first pump 240 draws the finely filtered wash fluid from filtered volume 220 to spray assembly 250 during step 530. Thus, articles within wash compartment 106 may be washed and/or rinsed with finely filtered wash fluid during step 530. As may be seen in FIG. 3, fine filtration media 212 of filter assembly 210 filters particles P from wash fluid flowing through fine filtration media 212 via cross-flow filtration during step 530.

In addition, second pump 242 urges wash fluid from unfiltered volume 214 to soil collection chamber 234 during step 530, as may be seen in FIG. 3. The second pump 242 also directs wash fluid within soil collection chamber 234 through coarse filtration media 236 during step 530. From, coarse filtration media 236, the coarsely filtered wash fluid is directed back into sump 200. Thus, coarse filtration media 236 of filter assembly 210 filters particles P from wash fluid flowing through coarse filtration media 236 via dead-end filtration during step 530. The particles P are collected within soil collection chamber 234, e.g., until a drain cycle of dishwasher appliance 100 removes or drains wash fluid and the particle P from soil collection chamber 234. Wash fluid from second pump 242 may also impact and close one-way valve 264 at step 530. Thus, one-way valve 264 interrupts fluid flow between unfiltered volume 214 and soil collection chamber 234 via connecting conduit 266 at step 530.

At step 540, the drain cycle of dishwasher appliance 100 is initiated. The drain cycle may be initiated after the wash cycle of dishwasher appliance 100 is completed and articles within wash compartment 106 are substantially clean. During the drain cycle, wash fluid is removed or drained from dishwasher appliance 100 via drain 262.

At step 550, diverter valve 260 is adjusted or actuated to the second configuration. Thus, as shown in FIG. 4, wash fluid within filter assembly 210 may flow from unfiltered volume 214 and/or soil collection chamber 234 to drain 262 via exit conduit 230 when diverter valve 260 is in the second configuration. Controller 137 may actuate diverter valve 260 from the first configuration to the second configuration when the drain cycle is initiated at step 540.

At step 560, second pump 242 is operated or worked after step 550, e.g., such that diverter valve 260 is in the second configuration during step 560. In FIG. 4, sump 200 and filter assembly 210 are shown during step 560 such that second pump 242 is working. As may be seen in FIG. 4, first pump 240 is deactivated or turned off during step 560. Second pump 242 urges wash fluid from unfiltered volume 214 to drain 262 via exit conduit 230 during step 560. Thus, second pump 242 drains unfiltered volume 214 of wash fluid during step 560, e.g., because diverter valve 260 is in the second configuration.

In addition, second pump 242 also urges wash fluid from soil collection chamber 234 during step 560. Thus, second pump 242 drains soil collection chamber 234 of wash fluid during step 560. In particular, as may be seen in FIG. 4, second pump 242 draws wash fluid from soil collection chamber 234 via connecting conduit 266 at step 560. Thus, one-way valve 264 permits fluid flow between soil collection chamber 234 and unfiltered volume 214 via connecting conduit 266 at step 560. In such a manner, particles P collected within soil collection chamber 234 at step 530 may be removed from soil collection chamber 234 at step 560.

As discussed above, method 300 may provide finely filtered wash fluid to spray assembly 250 during the wash cycle. Thus, method 300 may limit or prevent clogging of spray assembly 250 with particles P. Method 300 may also provide coarsely filtered wash fluid back to sump 200. Thus, larger particles P may be collected within soil collection chamber 234 in order to limit or prevent clogging of fine filter media 212. By collecting larger particles P within soil collection chamber 234, a capacity of filter assembly 210 may be increased and a frequency of draining and refilling of dishwasher appliance 100 may be reduced. In such a manner, method 300 may improve an energy and water efficiency of dishwasher appliance 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a tub defining a wash chamber;

a spray assembly positioned within the wash chamber;

a sump positioned at a bottom portion of the tub;

a filter assembly positioned adjacent the sump and having a fine filtration medium and a coarse filtration medium, the filter assembly assisting with defining a finely filtered volume, a soil collection chamber and an unfiltered volume, the fine filtration medium disposed between the unfiltered volume and the finely filtered volume within the sump, the coarse filtration medium disposed between the soil collection chamber and the wash chamber of the tub at the sump;

a spray conduit extending between the finely filtered volume of the filter assembly and the spray assembly;

a first pump coupled to the spray conduit and configured for selectively urging wash fluid from the finely filtered volume to the spray assembly through the spray conduit;

a circulation conduit extending between the unfiltered volume of the filter assembly and the soil collection chamber, said circulation conduit terminating at the soil collection chamber;

a second pump coupled to the circulation conduit and configured for selectively drawing wash fluid from the unfiltered volume of the filter assembly; and a diverter valve coupled to the circulation conduit, the diverter valve configured for selectively directing wash fluid from the unfiltered volume of the filter assembly to either the soil collection chamber or a drain.

2. The dishwasher appliance of claim 1, further comprising a controller in operative communication with the first pump, the second pump and the diverter valve, the controller programmed for actuating the diverter valve to a first configuration;

operating the first pump and the second pump after said step of actuating the diverter valve to the first configuration, the first pump drawing wash fluid from the unfiltered volume of the filter assembly through the fine filtration medium and directing the wash fluid to the spray assembly during said step of operating, the second pump urging the wash fluid from the unfiltered volume of the filter assembly to the soil collection chamber of the filter assembly and directing the wash fluid through the coarse filtration medium during said step of operating;

actuating the diverter valve to a second configuration after said step of operating; and working the second pump after said step of actuating the diverter valve to the second configuration, the first pump being deactivated during said step of working, the second pump urging the wash fluid from the unfiltered volume of the filter assembly to the drain during said step of working.

3. The dishwasher appliance of claim 2, wherein the fine filtration medium of the filter assembly filters particles from the wash fluid flowing through the fine filtration medium via cross-flow filtration during said step of operating.

4. The dishwasher appliance of claim 2, wherein the coarse filtration medium of the filter assembly filters particles from the wash fluid flowing through the coarse filtration medium via dead-end filtration during said step of operating.

5. The dishwasher appliance of claim 2, further comprising a one-way valve and a connecting conduit extending between the unfiltered volume of the filter assembly and the soil collection chamber, the one-way valve positioned at the connecting conduit.

6. The dishwasher appliance of claim 5, wherein the one-way valve is closed during said step of operating, the one-way valve being open during said step of working.

7. The dishwasher appliance of claim 6, wherein the soil collection chamber of the filter assembly is drained of wash fluid via the connecting conduit during said step of working.

8. The dishwasher appliance of claim 1, further comprising a one-way valve and a connecting conduit extending between the unfiltered volume of the filter assembly and the soil collection chamber, the one-way valve positioned at the connecting conduit.

9. The dishwasher appliance of claim 8, wherein the one-way valve is configured for hindering or preventing wash fluid from the unfiltered volume of the filter assembly from flowing to the soil collection chamber via the connecting conduit.

10. The dishwasher appliance of claim 8, wherein the one-way valve comprises a spring-loaded check valve.

11. The dishwasher appliance of claim 8, wherein the one-way valve is configured to actuate to a closed configuration by wash fluid from the second pump.

12. The dishwasher appliance of claim 1, wherein the fine filtration medium of the filter assembly is positioned for cross-flow filtration, and the coarse filtration medium of the filter assembly is positioned for dead-end filtration.

13. The dishwasher appliance of claim 1, wherein the fine filtration medium defines apertures for filtering wash fluid passing through the fine filtration medium, the apertures of the fine filtration medium being no greater than five hundred microns, and the coarse filtration medium also defining apertures for filtering wash fluid passing through the coarse filtration medium, the apertures of the coarse filtration medium being no greater than ten thousand microns.

* * * * *